US005259173A

United States Patent [19]

Roberts et al.

[11] Patent Number: 5,259,173

[45] Date of Patent: Nov. 9, 1993

[54] APPARATUS FOR CONVEYING AND PACKAGING GROUPS OF ARTICLES

[75] Inventors: John T. Roberts, Clover; Philip L. Reid, Duncan; Philip S. LaChapelle, Tega Cay; Danny R. Williams, Clover, all of S.C.

[73] Assignee: Roberts Systems, Inc., Charlotte, N.C.

[21] Appl. No.: 687,436

[22] Filed: Sep. 23, 1991

Related U.S. Application Data

[60] Division of Ser. No. 667,742, Feb. 25, 1991, abandoned, which is a continuation of Ser. No. 584,383, Sep. 13, 1990, abandoned, which is a continuation of Ser. No. 332,766, Apr. 3, 1989, abandoned, which is a division of Ser. No. 7,624, Jan. 28, 1987, Pat. No. 4,854,111, which is a continuation-in-part of Ser. No. 925,565, Oct. 31, 1986, abandoned, which is a continuation of Ser. No. 666,046, Oct. 29, 1984, Pat. No. 4,633,653.

[51] Int. Cl.[5] ..... B65B 35/50; B65B 5/06; B65B 63/02

[52] U.S. Cl. ..... 53/529; 53/245; 53/252; 53/535

[58] Field of Search ..... 53/529, 438, 439, 245, 53/535, 252, 251, 250, 566

[56] References Cited

U.S. PATENT DOCUMENTS

| | | | |
|---|---|---|---|
| 3,531,905 | 10/1970 | Omori | 53/535 X |
| 3,566,576 | 3/1971 | Ayres et al. | 53/535 X |
| 4,492,070 | 1/1985 | Morse et al. | 53/566 X |
| 4,577,453 | 3/1986 | Hofeler | 53/529 X |
| 5,038,549 | 8/1991 | Nordstrom | 53/535 X |

*Primary Examiner*—James F. Coan
*Attorney, Agent, or Firm*—Hardaway Law Firm

[57] ABSTRACT

An apparatus for packaging articles having a conveyor; means associated with the conveyor for forming groups of articles and moving the groups independently of other articles on the conveyor; means for moving the groups of articles transversely to the conveyor; an elevator for receiving said groups of articles in stacked groupings; and means for moving the stacked groupings into a carton. Means are also provided for assembling and closing the carton upon receipt of the stacked groupings.

6 Claims, 5 Drawing Sheets

APPARATUS FOR CONVEYING AND PACKAGING GROUPS OF ARTICLES

This application is a division of application Ser. No. 07/667,742 filed on Feb. 25, 1991, now abandoned, which is a continuation of application Ser. No. 07/584,383 filed on Sep. 13, 1990, now abandoned, which is a continuation of application Ser. No. 07/332,766 filed on Apr. 3, 1989, now abandoned which is a divisional of application Ser. No. 07/007,624 filed on Jan. 28, 1987, which is now U.S. Pat. No. 4,854,111, which was a continuation-in-part of application Ser. No. 06/925,565 filed Oct. 31, 1986, now abandoned, which was a continuation of application Ser. No. 06/666,046 filed Oct. 29, 1984, which is now U.S. Pat. No. 4,633,653.

BACKGROUND OF THE INVENTION

This invention relates generally to the art of conveying and more particularly to an apparatus for conveying a plurality of articles into a case for shipment.

Many and varied apparatus have existed within the prior art for conveying articles for ultimate packing into larger containers or cases for shipment or storage and sometimes even for shipment and display. The food distribution industry is particularly dependant upon the use of cases of individual articles for ultimate sale to the consumer through retailers or vending machines.

While many types of mechanical devices have been utilized by the food distribution industry, the handling and packing of fragile irregularly shaped articles has remained, to a large extent, a manual effort. Examples of such fragile and irregularly shaped articles include snack foods particularly those packed in flexible containers such as potato chips and other chip-type articles.

Even with regularly shaped articles, such as cigarette cartons which are packed into cases in rows, the packing effort is subject to a large degree of manual handling when such items are packed into tight-fitting cases.

Various apparatus have existed, however, which lend themselves to conveying and case packing, examples of which are given below.

U.S. Pat. No. 708,218 describes an apparatus for packing oil cakes. U.S. Pat. No. 3,735,561 describes an apparatus for packing single articles one at a time into a carton. U.S. Pat. No. 4,040,230 describes an apparatus for compacting garbage and placing into a container.

U.S. Pat. No. 3,826,058 describes an apparatus for inserting articles into a container while interleaving paper between layers.

U.S. Pat. No. 3,618,285 describes an apparatus for filling boxes with discreet articles such as fruit. U.S. Pat. No. 3,022,615 describes an apparatus for forming cartons about a plurality of articles. U.S. Pat. No. 2,956,381 describes an automatic packing apparatus for orienting and packing fragile articles within a shipping container.

None of the above prior art, however, overcomes the shortcomings which exist with regard to the case packing of a plurality of articles, particularly fragile articles which are irregularly shaped.

SUMMARY OF THE INVENTION

It is thus an object of this invention to provide a novel apparatus for packaging a plurality of articles into cases. It is a further object of this invention to provide an apparatus for packing a plurality of fragile and irregularly shaped articles into a case for shipment.

It is a still further and more particular object of this invention to provide such an apparatus which is capable of handling regularly shaped articles and packaging them into tight fitting preformed containers.

These as well as other objects are accomplished by an apparatus for packaging articles having a conveyor; means associated with a conveyor for forming groups of articles and moving the groups independently of other articles on the conveyor; means for moving the groups of articles transversely to the conveyor; an elevator for receiving said groups of articles in stacked groupings; and means for moving the stacked groupings into a carton. Means are also provided for assembling and closing the carton upon receipt of the stacked groupings.

DETAILED DESCRIPTION

In accordance with this invention, it has been found that an overall combination of article conveying and grouping means may be uniquely provided with an elevator for stacking such groups and a carton assembler and closer for receiving the stacked groupings. Various advantages and features will become apparent from a reading of the following description given with reference to the various figures and drawings.

Figure 1:
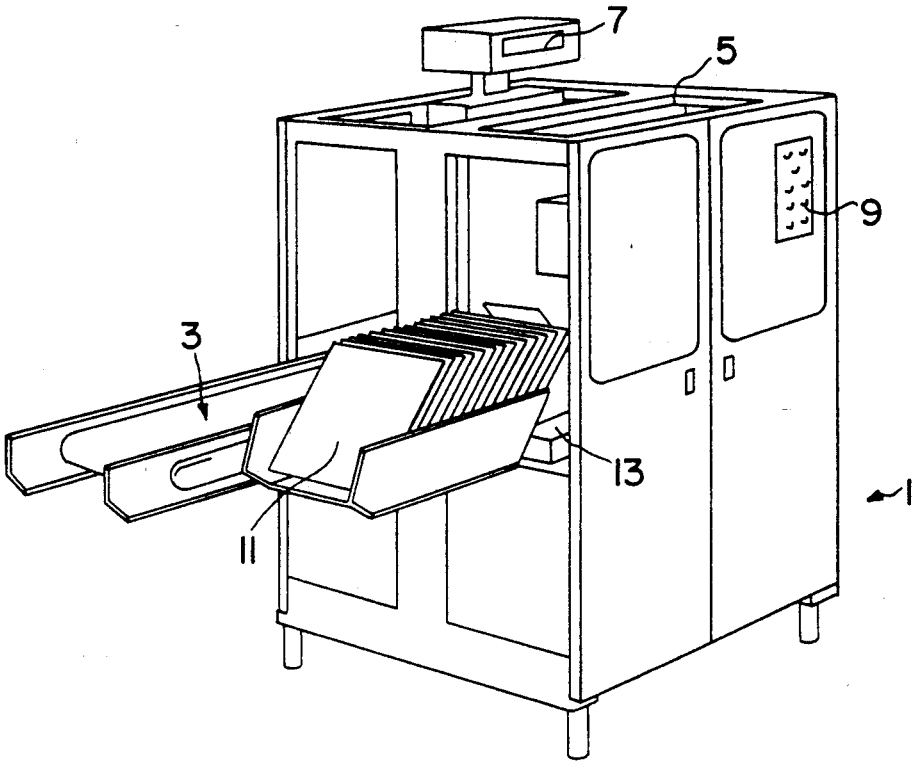
FIG. 1 is a perspective view of the apparatus in accordance with this convention.

FIG. 1 of the drawings is a schematic view of the overall apparatus 1 of this invention as will be broken down by further description with reference to other figures and drawing. It is seen, however, in FIG. 1 that the apparatus comprises a conveyor 3, a machine framework 5, having an operator display 7 thereon, operator controls 9, means for presenting a carton 11 for receipt of articles at position 13.

Figure 2:
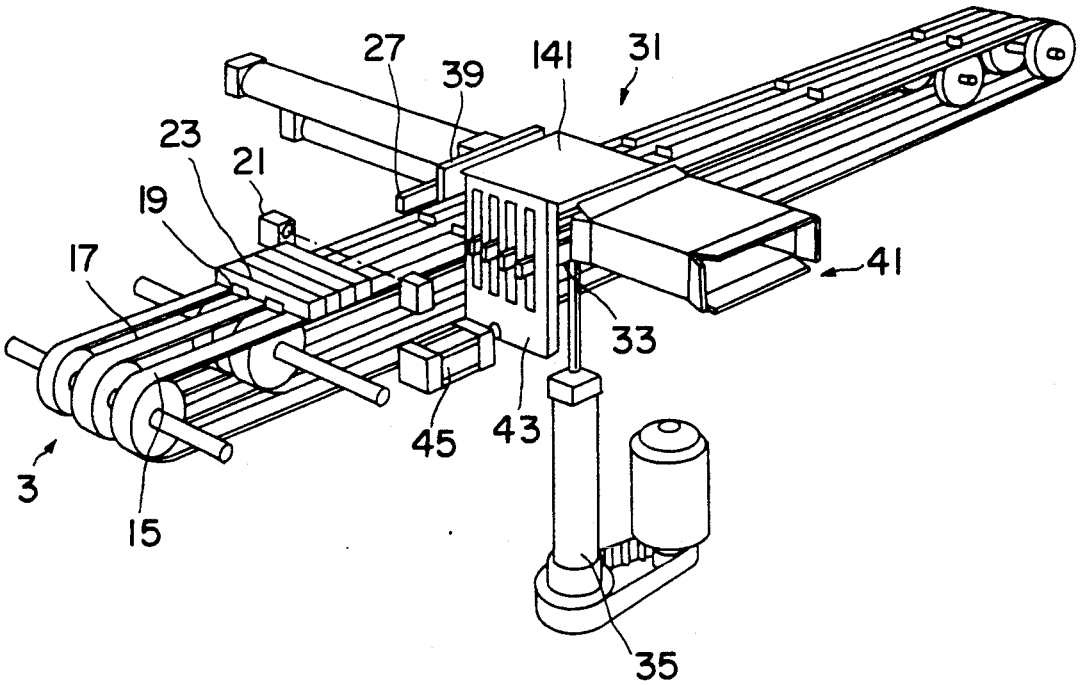
FIG. 2 is a perspective view of the conveyor and elevator portion of the apparatus in accordance with this invention with surrounding apparatus not shown.

FIG. 2 of the drawings is a perspective view of components with the housing 5 removed in order to permit better viewing. As seen in FIG. 2 of the drawings, conveyor 3 is formed of a plurality of belts 15 with spaces 17 therebetween. Within the spaces 17 are means 19 in the form of lugs for independently moving articles along the conveying direction independently of the conveyor 3. An article counting means 21 is provided to count a predetermined number of articles conveyed across conveyor 3 for activation of means 19 for forming a group of articles. Upon counting an appropriate predetermined number of articles, means 19 is activated to move the group of articles, which is illustrated here as 23 into position adjacent transverse moving means 27, whereupon transverse moving means 27 moves transversely to conveyor 3 to position a group of articles within elevator means 31, whereupon elevator means 31 upon a lower surface thereof 33 is moved downwardly the height of a layer of a group of articles by means for vertically moving 35. Upon movement downward the next group of articles is moved on top of the first group by means 27.

Upon receipt of an appropriate number of layers of grouped articles the elevator is lifted to place the layers against the underside of elevator top 141 and aligned with carton 41 opening, then means 39 is activated for moving the entire stack of grouped articles into an awaiting carton 41.

Upon movement of the stack into carton 41, bottom surface 33 is immediately returned to receive the next group of articles for the generation of an additional stack. The timing and sequencing of conveyor 3, means for grouping 19, means for moving transversely 27, for moving 39 and vertically moving elevator 35 are such that conveyor 3 never varies its speed, but moves continuously at a desired velocity.

Elevator 31 includes an upper plate 141 against which lower member 33 moves stacked articles to compress such articles in a vertical direction prior to actuation of means 39. Elevator 31 is additionally provided with a side plate 43 and means for horizontal actuation thereof 45 in order to compress the stacked articles horizontally prior to actuation of means 39. Side plate 43 operates against a plate on the opposite side thereof not shown in FIG. 2.

Figure 3:
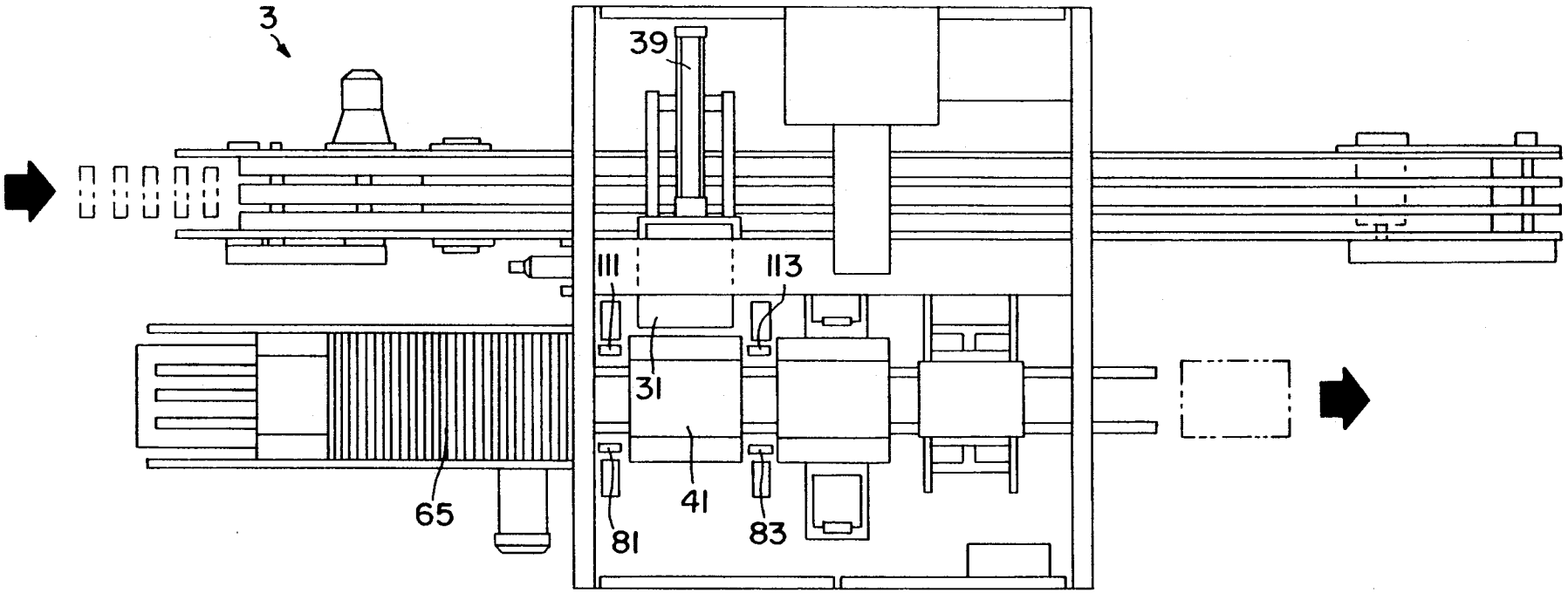
FIG. 3 is plan view of the apparatus in accordance with this invention.

FIG. 3 of the drawings is a plan view of the entire apparatus showing the conveyor 3, stack mover 39 and elevator 31. While carton 41 has been described in the previous embodiment as merely existing adjacent elevator 31, description will now be given of the means for presenting carton 41 at the appropriate location adjacent elevator 31.

Figure 4:
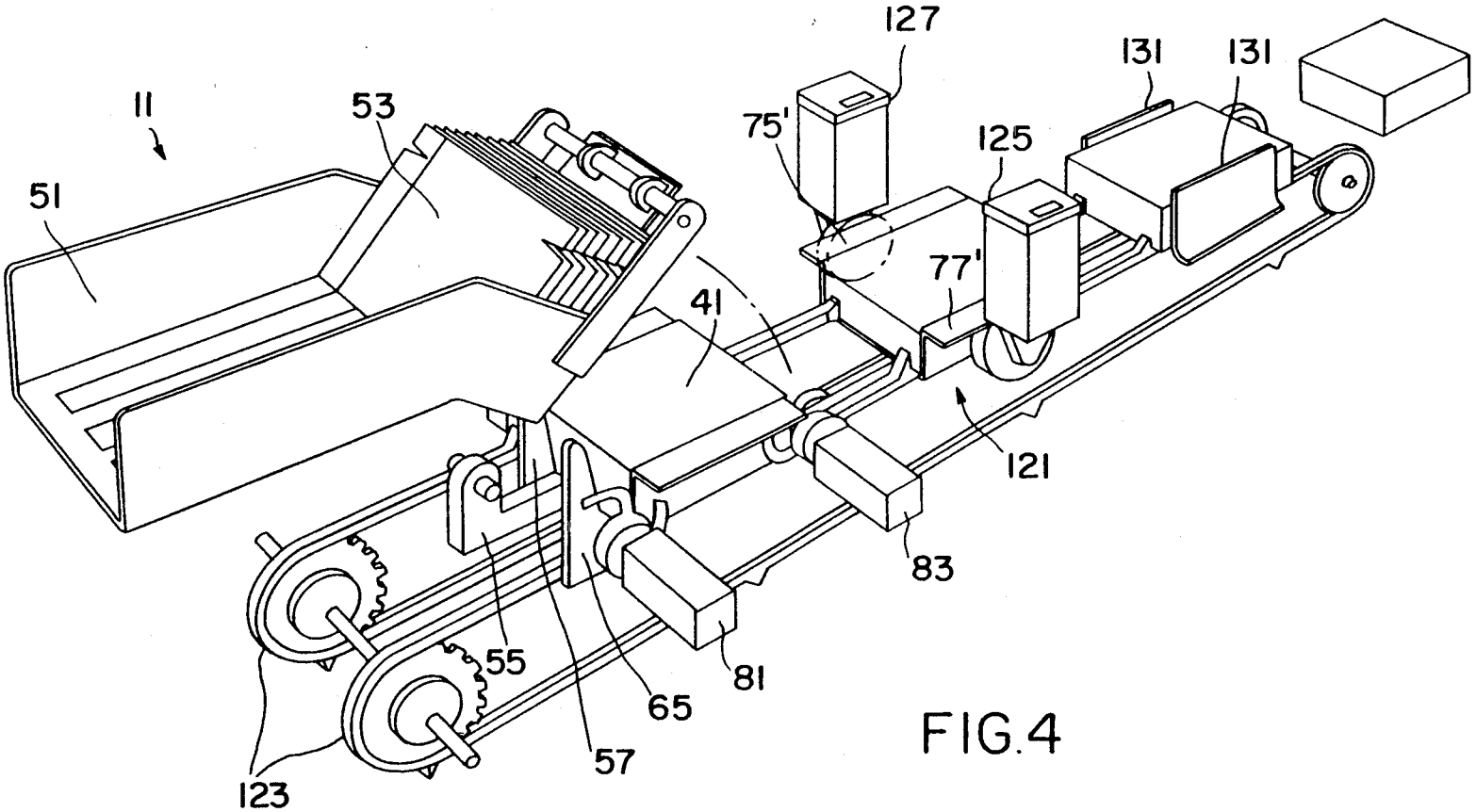
FIG. 4 is a perspective view of the means for presenting an assembled carton at the appropriate location.
Figure 5:
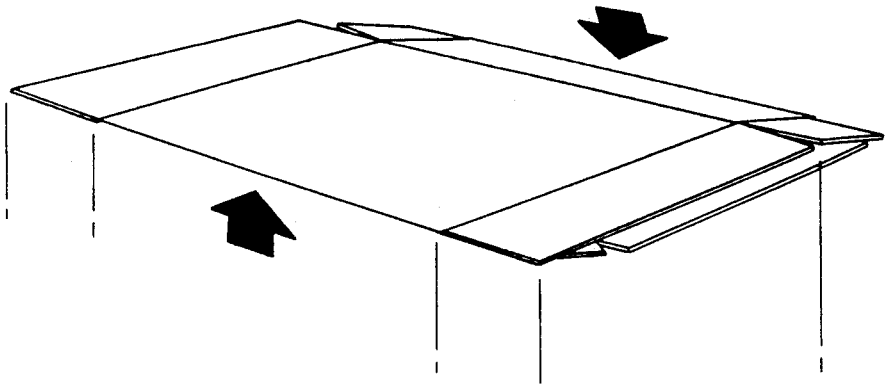
FIGS. 5 and 6 are schematic perspective views of a carton blank being set up and positioned for flap closing.

FIG. 4 of the drawings is a view showing portions of the components visible in FIGS. 1 and 3 of the means for presenting 11. The means for presenting 11 comprises a magazine 51 having a plurality of flat carton blanks 53 therein. Means 55 in the form of a pivoted carton pull-down arm with vacuum cups, not shown, is provided for moving an individual carton from magazine 51 against set up ramps 57. The carton 41 generally goes through the opening motions illustrated in FIGS. 5 and 6 of the drawings. This is brought about by movement of the arm 55 causing one surface of the carton to interfer with the curved surfaces of ramp 57.

Figure 6:
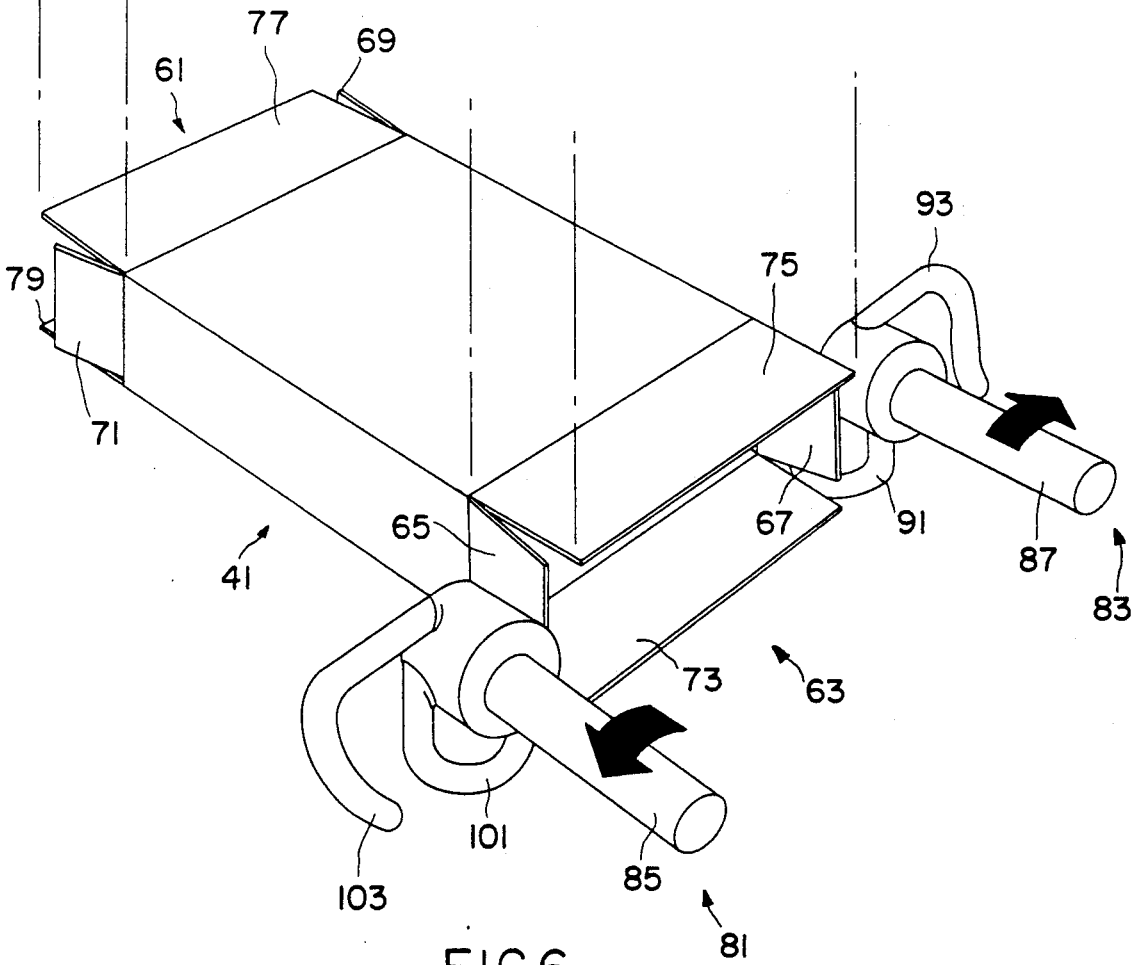
Figure 7:
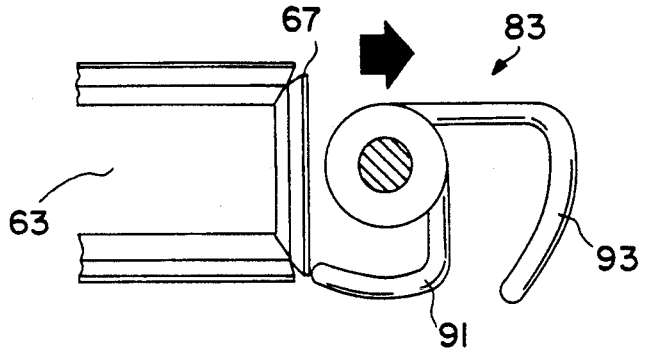
FIG. 7 is a partial end view of a carton with means for flap closing at the initial position.
Figure 8:
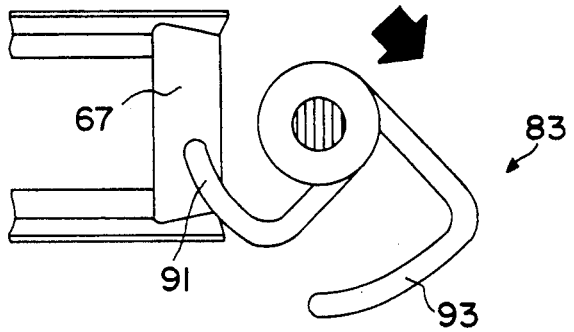
FIG. 8 is a partial end view of a carton and flap closing means rotated 45° from the FIG. 7 view.
Figure 9:
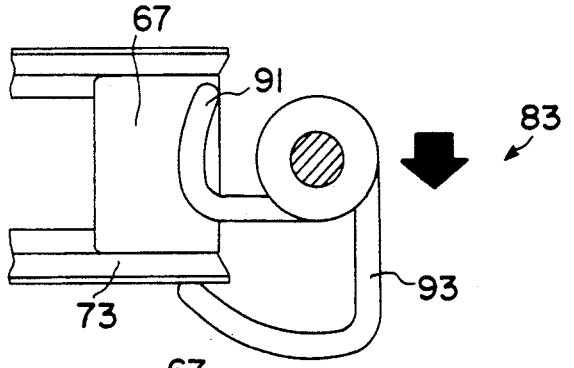
FIG. 9 is a figure similar to FIG. 8 with the flap closing means advanced 90° from the FIG. 7 view.

Upon positioning of carton 41 at the appropriate location, it should be noted from FIG. 6 that carton 41 has an opening 61 which is generally adjacent elevator 31 and an opening 63 which is remote from elevator 31. Each of the openings is provided with a pair of minor flaps 65, 67 at opening 63 and 69 and 71 at opening 61. Each opening is also provided with a pair of major flaps illustrated as 73 and 75 at opening 63 and 77 and 79 at opening 61.

Figure 10:
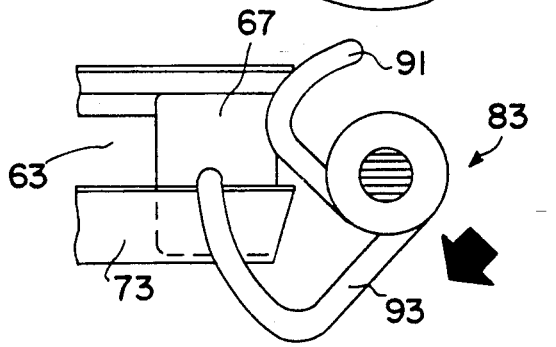
FIG. 10 is a view similar to FIG. 9 with the flap closing means advanced 135° from the FIG. 7 view.
Figure 11:
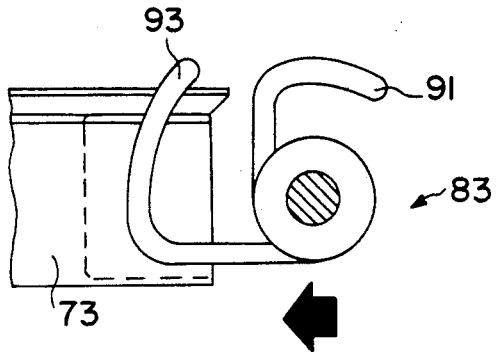
FIG. 11 is a view similar to FIG. 10 with the flap closing means advanced 180° from the view of FIG. 7.

Unique means for closing the pair of minor flaps and one of the major flaps of each opening are illustrated in FIGS. 6 through 11, which will be better understood from the description which follows. Means for flap closing are illustrated at 81 and 83 of FIG. 6. It is seen that means 81 and 83 are generally mirror images of one another with means 81 arranged to be rotated counterclockwise by shaft 85; while means 83 is arranged to be rotated in a clockwise direction by shaft 87. Description will now be given with reference to means 83 which is illustrated in various positions in FIGS. 7, 8, 9, 10 and 11. Means 83 has a first finger 91 for contacting minor flap 67 and moving it into the various positions as it rotates 45° between each figure from FIG. 7 to FIG. 8 to FIG. 9 to FIG. 10. It is seen in FIG. 10 that flap 67 is totally closed about a portion of opening 63, which was in effect largely achieved by the position illustrated in FIG. 9.

Means 83 additionally is provided with a major flap closing finger 93 which follows finger 91 until the FIG. 10 position at which point it has begun to contact major flap 73 and move flap 73 into the closed position over minor flap 67 about opening 63.

Simultaneously with the operation of means 83 on one end of opening 63, means 81 are operating in like fashion with its minor flap contacting finger 101 closing minor flap 65 followed by its major flap contacting finger 103 operating in conjunction with flap closing finger 93 to both simultaneously close both sides of major flap 73.

Referring to FIG. 3 of the drawings, it is seen that flap closing means 81 and 83 as just described are provided on one side of carton of 41, while on the other side thereof are similar flap closing means 111 and 113.

Flap closing means 81 and 83 operate so as to have flaps 65, 67 and 73 closed prior to being contacted by any articles moved by means 39.

In a like fashion, flap closing means 111 and 113 operate only after articles have been inserted into carton 41.

Referring again to FIG. 4 of the drawings, it is seen that after each end of carton 41 has had two minor flaps and one major flap closed and then moved to position 121 by a movement of movement means 123, where means 125 and 127 provide adhesive, preferably a hot melted adhesive to the last remaining major flaps 75' and 77' for final closure of the carton by means 131 positioned down stream from station 121.

It is thus seen that the apparatus of this invention provides a novel conveying means, a novel elevator means and a novel carton assembling and closing means which operate in conjunction with one another for a highly efficient article moving and packaging apparatus. As many variations will be apparent from a reading of the above description which is exemplary in nature, such variations are included within the spirit and scope of the following appended claims.

What is claimed is:

1. An elevator for receiving groups of articles, comprising:

a bottom surface for receipt of a first group of said articles;

means for vertically moving said bottom surface downwardly for receipt of a subsequent group of said articles upon said first group of articles;

means for vertically moving said bottom surface and said first and subsequent groups of articles upwardly, thereby compressing said articles vertically; and means for compressing said first and subsequent groups horizontally.

2. The elevator according to claim 1 wherein a plate is provided above said bottom surface and wherein said means for vertical movement are capable of moving vertically upward against said plate to provide said means for compressing vertically.

3. The elevator according to claim 1 further compressing a side plate and means for moving said side plate to provide said means for compressing said first and subsequent groups horizontally.

4. An elevator for receiving groups of articles, comprising:

a bottom surface for receipt of a first group of said articles;

means for vertically moving said bottom surface downwardly for receipt of a subsequent group of said articles upon said first group of articles;

means for compressing said first and subsequent groups of articles vertically; and means for compressing said first and subsequent groups horizontally.

5. The elevator according to claim 4 wherein a plate is provided above said bottom surface and wherein said means for vertical movement are capable of moving vertically upward against said plate to provide said means for compressing vertically.

6. The elevator according to claim 4 further comprising a side plate and means for moving said side plate to provide said means for compressing said first and subsequent groups horizontally.

* * * * *